US008925425B2

(12) United States Patent
Merhar

(10) Patent No.: US 8,925,425 B2
(45) Date of Patent: Jan. 6, 2015

(54) WRENCH

(71) Applicant: Hilti Aktiengesellschaft, Schaan (LI)

(72) Inventor: Thomas Merhar, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 51 days.

(21) Appl. No.: 13/743,683

(22) Filed: Jan. 17, 2013

(65) Prior Publication Data

US 2013/0180365 A1 Jul. 18, 2013

(30) Foreign Application Priority Data

Jan. 18, 2012 (DE) ..... 10 2012 200 644

(51) Int. Cl.

| | |
|---|---|
| ***B25B 13/00*** | (2006.01) |
| ***B25B 13/28*** | (2006.01) |
| ***B25B 13/04*** | (2006.01) |
| ***B25B 13/46*** | (2006.01) |
| ***B25B 13/52*** | (2006.01) |

(52) U.S. Cl.

CPC ..... *B25B 13/28* (2013.01); *B25B 13/04* (2013.01); *B25B 13/46* (2013.01); *B25B 13/52* (2013.01)

USPC ..... 81/90.6; 81/96; 81/111

(58) Field of Classification Search

USPC ..... 81/90.1, 90.3, 90.4, 90.6, 98

See application file for complete search history.

(56) References Cited

U.S. PATENT DOCUMENTS

| | | | | | |
|---|---|---|---|---|---|
| 746,705 | A | * | 12/1903 | Hutchins | 81/111 |
| 1,524,708 | A | * | 2/1925 | Grant et al. | 81/90.6 |
| 1,539,943 | A | * | 6/1925 | Greve | 81/90.6 |
| 1,730,096 | A | * | 10/1929 | Smith | 81/90.6 |
| 2,180,979 | A | * | 11/1939 | Eby et al. | 72/358 |
| 3,097,552 | A | | 7/1963 | Kelley | |
| 4,616,534 | A | | 10/1986 | Park et al. | |
| 6,257,098 | B1 | * | 7/2001 | Cirone | 81/119 |
| 6,978,701 | B1 | * | 12/2005 | Buchanan et al. | 81/98 |
| 2010/0122610 | A1 | | 5/2010 | Chen | |

FOREIGN PATENT DOCUMENTS

| | | |
|---|---|---|
| DE | 600 10 681 | 5/2005 |
| DE | 20 2009 006 978 | 7/2009 |
| DE | 20 2009 008 148 | 8/2009 |
| EP | 1 165 291 A1 | 1/2002 |
| EP | 1165291 | 5/2004 |
| WO | WO 00/58057 | 10/2000 |
| WO | WO 2010/013013 | 2/2010 |

* cited by examiner

*Primary Examiner* — Monica Carter
*Assistant Examiner* — Melanie Alexander
(74) *Attorney, Agent, or Firm* — Davidson, Davidson & Kappel, LLC

(57) ABSTRACT

A wrench fitted with a handle and a ring that can be swiveled open to grip a screw head or a nut with a positive fit, whereby the ring has a first segment that is arranged on the handle, and a free second segment as well as a connecting member that joins the second segment to the first segment in an articulated manner. A lever is provided on the connecting member so that the ring that can be swiveled open.

17 Claims, 1 Drawing Sheet

WRENCH

This claims the benefit of German Patent Application DE 10 2012 200644.3, filed Jan. 18, 2012 and hereby incorporated by reference herein.

The present invention relates to a wrench. Such a wrench is fitted with a handle and a ring that can be swiveled open to grip a screw head or a nut with a positive fit, especially non-rotatably, whereby the ring has a first segment that is arranged on the handle, and a free second segment as well as a connecting member that joins the second segment to the first segment in an articulated manner.

BACKGROUND

A generic wrench is disclosed in European patent application EP 1 165 291 A1. This publication discloses a wrench having a ring that can be swiveled open and that provides a ratcheting function.

SUMMARY OF THE INVENTION

It is an object of the present invention is to refine a prior-art wrench in such a way that it is very user-friendly and very versatile to use, while also being highly reliable and having a simple construction.

The present invention provides a wrench that is characterized in that a lever for swiveling the ring open is arranged on the connecting member.

A first basic idea of the invention can be seen in that a lever is provided on the ring that can be swiveled open. This lever can swivel the ring into an open position, so that the ring can be slid sideways in the radial direction onto a threaded rod. This eliminates the need to awkwardly twist on the wrench starting at the end of the threaded rod, so that the wrench can especially be used in the middle of the threaded rod, even if the threaded rod is blocked for the ring at one or at both ends. The invention is based, among other things, on the idea that the fact that the ring can be swiveled open not only brings about a ratcheting function for loosening and/or tightening a nut or a screw, but also allows the ring to be opened, so that it can be slid radially onto a threaded rod. The invention is based on this and it provides for a lever with which the swiveling mechanism can be actuated very easily. According to the invention, particularly for purposes of opening the ring, it is no longer necessary to grip the ring itself, since the lever according to the invention makes it possible to activate the swiveling mechanism from a location at a distance from the ring. In this manner, according to the invention, the ring can be easily opened, even in hard-to-access positions, and this can be advantageously done with the same hand that is also holding the handle. Consequently, a very high level of user friendliness and great versatility of use can be attained according to the invention.

Another basic idea of the invention is to attach the lever to the connecting member that is arranged between the free second segment and the first segment that is fixed with respect to the handle. This can ensure that the lever does not interfere with the ratcheting function. Moreover, since the connecting member travels a relatively short distance when the ring is opened, the lever path required for opening the ring can also be short. Therefore, according to the invention, an especially compact wrench is obtained, which further enhances the versatility of use.

According to the invention, the handle, the first segment, the connecting member and the second segment form a chain. As seen along this chain, the first segment is situated closer to the handle than the second segment. In other words, according to the invention, the second segment can only be attached to the handle indirectly, namely, via the connecting member and the first segment. The two segments and the connecting member are advantageously rigid, and are especially made of a metal. According to the invention, the ring has a ratcheting function that is suitable for loosening and tightening one of the nuts. The ring is especially attached to the handle at the end of the handle.

It is particularly preferred that pressing the lever towards the first segment causes the ring to open. According to this embodiment, the ring is opened by means of a compression movement that does not require a great deal of space, so that the wrench can be used in even tighter spaces, which further increases its range of use.

One embodiment that is structurally very simple and at the same time user-friendly can be achieved in that the lever extends, at least in certain sections, along the outside of the first segment facing away from the second segment and/or from the inside of the ring. In particular, it can be provided that the first segment runs between the lever and the second segment, at least in certain sections.

According to the invention, the lever can have a pressure area. This pressure area can serve for placement of a finger in order to press the lever towards the first segment, in other words, to open the ring.

It is especially preferred for the lever in the pressure area to enclose, together with the handle, an angle smaller than 60°, especially smaller than 45°. This allows the dimensions of the wrench to be further reduced while retaining the convenient handling, thus expanding the scope of application.

It is likewise practical for the space between the pressure area of the lever and the first segment to be left free. Since, according to this embodiment, no other elements are present between the pressure area and the first segment, the available lever path is particularly large. This, in turn, allows the dimensions to be reduced yet again.

Another advantageous embodiment of the invention consists of the fact that the connecting member is articulated onto the first segment so that it can be pivoted around a first pivot axis, and that the second segment is articulated onto the connecting member so that it can be pivoted around a second pivot axis, whereby the first pivot axis and the second pivot axis run parallel to each other and/or at a distance from each other, As a result, a very large opening angle for the ring can be provided, along with great reliability and a very simple design. In particular, it can be provided that the first segment, the connecting member and the second segment form a chain that can move one-dimensionally, that is to say, an articulated chain. Between the first segment and the handle, there can be another articulation that allows pivoting in another spatial direction. However, the first segment and the handle can also be joined rigidly and/or can be configured as a single piece.

It is particularly advantageous for the lever to run parallel to the two pivot axes, especially along its entire length. Since the lever in this embodiment is not twisted, it is particularly easy to manufacture.

It is likewise preferred for the lever to be angled at least once, preferably around at least one bending axis that runs parallel to the pivot axes. Therefore, the lever is preferably configured so as to be L-shaped, at least in certain areas. This can be advantageous in terms of the size and also of the manufacturing work involved. For instance, in order to further improve the handling, it can also be provided that the lever is angled several times in at least two bending areas that are at a distance from each other. In this manner, the lever can be adapted even better to the shape of the segment that is beneath it, and/or improper use can be avoided. Preferably, the direction of the curvature is the same in the various bending areas. In particular, the lever can be curved towards the first segment in all of the bending areas.

It can be preferably provided that the lever is made of a bent metal sheet. This is advantageous in terms of the manufacturing work involved.

A particularly sturdy and reliable design that is, at the same time, structurally very simple can be achieved in that the connecting member has a front bearing plate on which preferably the two segments are mounted, a rear bearing plate on which preferably the two segments are mounted, and a middle web that joins the two bearing plates. In this case, the lever can be easily attached to the middle web. The individual bearing plates can also have recesses and/or can be configured so as to have multiple parts, whereby the individual parts can also be joined together only by the middle web.

In particular, it can be provided that the connecting member has a pivot pin for the first segment, and a second pivot pin for the second segment. The pivot pins can especially be configured as screws, in other words, with an outer thread, since this translates into an especially simple attachment. Particularly preferably, both pivot pins extend between the two bearing plates.

It is advantageous according to the invention for the ring to have a ratcheting function. This ratcheting function can be realized, for example, in that, when the wrench is turned in the releasing direction relative to the nut or to the screw head, the second segment can swivel open away from the first segment, so as to release a non-rotatable connection between the ring on the one hand, and the nut or the screw head on the other hand, and in that a return mechanism is provided that once again moves the second segment back towards the first segment.

It is likewise advantageous that a compression spring is arranged between the two segments in order to close the ring. This compression spring forces the ring into a closed position. It can also constitute the return mechanism needed for the ratcheting function.

It is likewise preferred for the first segment to have a first tooth and for the second segment to have a second tooth, whereby the flank of the first tooth facing the inside of the ring is in contact with the second tooth. According to this embodiment, the two segments are partially intermeshed. On the one hand, the teeth that mesh in only one direction ensure that the second segment is not only moved translatorially but also rotationally relative to the first segment when the ring is opened by actuating the lever. As a result, the ring can open particularly wide, even in the case of a short lever path, which facilitates, among other things, the insertion of a threaded rod into the ring. On the other hand, the teeth do not prevent the second segment from pivoting away from the first segment, so that the ratcheting function is not detrimentally affected.

Another advantageous embodiment of the invention consists of the fact that the wrench, as seen through the ring, has a front facing the observer and a rear facing away from the observer, and that the front has a colored or geometrical marking so that it can be distinguished from the rear. This embodiment takes into account that, with a wrench according to the invention, the ratcheting function generally cannot be reversed, so that tightening and loosening a nut can require different orientations of the wrench. The advantageous marking makes it possible to recognize particularly quickly the rotational direction for which the wrench is oriented.

Moreover, it is provided according to the invention that the first segment has at least one edge located inside the ring, and/or that the second segment has at least one edge located inside the ring. These edges serve to hold corresponding outer edges of the screw head or of the nut.

Fundamentally, the embodiments described above and below can be combined as desired.

BRIEF DESCRIPTION OF THE DRAWINGS

The invention will be described in greater detail below on the basis of preferred embodiments that are shown schematically in the accompanying figures. The figures schematically show the following.

DETAILED DESCRIPTION

Figure 2:
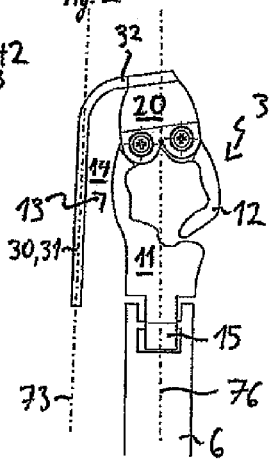
FIG. 2: a front view of the wrench from FIG. 1, with a handle.

For the sake of clarity, the handle according to the invention is merely sketched in FIG. 2.

The figures show a variant of a wrench according to the invention in various views and operating states.

Figure 3:
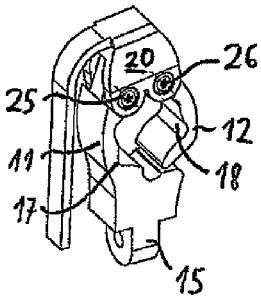
FIG. 3: a second perspective view of the wrench from FIG. 1.

As is shown especially in FIG. 2, the wrench has a handle 6 onto whose end a ring 3 is articulated. This ring 3 has (in particular, see FIG. 1) a first segment 11, a second segment 12 that runs approximately parallel to it, and a connecting member 20 that joins the two segments 11 and 12 to each other. The first segment 11 has an eye 15 onto which the handle 6 is articulated (in particular, see FIGS. 1 and 2). The first segment 11 has two edges 17 on the inside of the ring 3, while the second segment 12 has two edges 18 on the inside of the ring 3 (in particular, see FIG. 3). The edges 17 and 18 run parallel to each other and hold the outer edges of a nut that is arranged inside the ring 3 or of a screw head that is situated there. As can be especially seen in FIG. 4, the segments 11 and 12 have convex sections 70 between the edges 17 and 18, and these convex sections 70 serve to form a positive-fitting non-rotatable connection between the ring 3 and a nut that is arranged inside the ring 3 or a screw head that is situated there.

Figure 1:
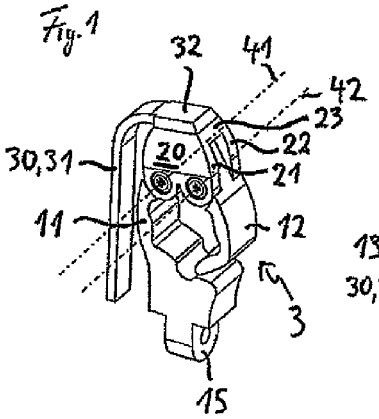
FIG. 1: a first perspective view of a variant of the wrench according to the invention.

As can be seen especially in FIG. 1, the connecting member 20 is articulated onto the first segment 11 so that it can be pivoted around a pivot axis 41, and articulated onto the second segment 12 so that it can be pivoted around a pivot axis 42, whereby the two pivot axes 41 and 42 run parallel to each other and are at a distance from each other. The fact that the segments 11 and 12 can be pivoted around the two pivot axes 41 and 42 respectively makes it possible to change the ring 3 from a closed position depicted in FIGS. 4 and 5 into an open position depicted in FIGS. 6 and 7. In the closed position depicted in FIGS. 4 and 5, the ring 3 can grip the nut or the screw head so as to create a non-rotatable positive fit. In particular, in the closed position, the end of the second segment 12 located opposite from the connecting member 20 can be in contact with the first segment 11. In the open position depicted in FIGS. 6 and 7, in contrast, the end of the second segment 12 located opposite from the connecting member 20 is at a distance from the first segment 11, so that the ring 3 can be slid radially onto a threaded rod.

The pivot axis of the eye, in other words, the pivot axis around which the handle 6 can be pivoted relative to the ring 3, runs perpendicular to the pivot axes 41 and 42.

Figure 5:
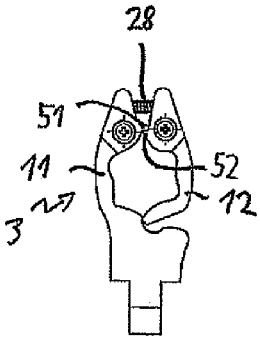
FIG. 5: the wrench from FIG. 1, with the ring closed, in a front view, whereby the connecting member has been left out for purposes of showing the spring and the teeth.
Figure 7:
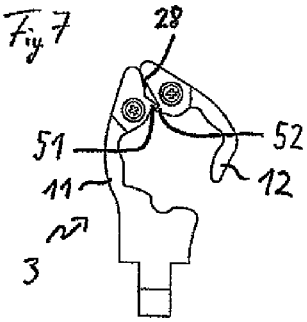
FIG. 7: the wrench from FIG. 1, with the ring swiveled open, in a front view, whereby the connecting member has been left out for purposes of showing the spring and the teeth.

As is shown in FIGS. 5 and 7, a compression spring 28 is arranged between the two segments 11 and 12 and it is compressed when the ring 3 is opened, thus forcing the ring 3 into its closed position. In particular, the compression spring 28 can be arranged inside the connecting member.

As is further shown in FIGS. 5 and 7, a tooth 51 protrudes radially from the first segment 11, and its flank facing the inside of the ring 3 strikes against a second tooth 52 that protrudes radially from the second segment 12. The two teeth 51 and 52, which mesh only in one direction of rotation, ensure that the second segment 12 executes a rotational movement relative to the connecting member 20 around the pivot axis 42 and that the ring 3 opens when the connecting member 20 is pivoted relative to the first segment 11 around the pivot axis 41.

Figure 4:
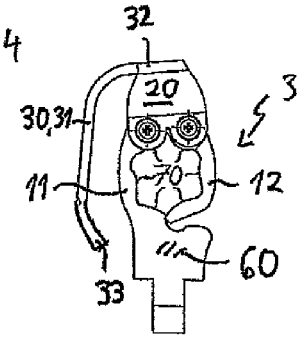
FIG. 4: the wrench from FIG. 1, with the ring closed, in a front view showing a modified lever.

The ring 3 that can be swiveled open provides a ratcheting function that is implemented in that, when the wrench is turned in the release direction, the second segment 12 can swerve away from the first segment 11, and it is subsequently returned by the compression spring 28. In order to allow the user to quickly recognize which is the releasing direction, a colored marking 60, as shown in FIG. 4, can be provided on the face located on the front of the wrench as seen through the ring 3, said marking 60 being absent on the rear face of the wrench, which cannot be seen in FIG. 4.

As is especially shown in FIG. 1, the connecting member 20 has a front bearing plate 21, a rear bearing plate 22 running parallel to the front bearing plate 21 as well as a middle web 23 which runs perpendicular to the bearing plates 21, 22 and which joins the two bearing plates 21, 22 on their outer edges facing away from the inside of the ring 3. As is especially shown in FIG. 3, the connecting member 20 also has two pivot pins 25 and 26 that run parallel to each other and that are configured as slotted screws. The two pivot pins 25 and 26 are arranged in recesses of the front bearing plate 21 and in recesses of the rear bearing plate 22. The first segment 11 is mounted so as to pivot on the pivot pin 25 while the second segment 12 is mounted so as to pivot on the pivot pin 26.

As shown, among others, in FIGS. 1 and 2, the wrench also has a lever 30 that serves to open the ring 3 against the action of the compression spring 28. The lever 30 is attached, for instance, welded, to the connecting member 20, and it consists of a bent metal sheet that runs parallel to the two pivot axes 41, 42. The lever 30 is angled so as to be L-shaped, whereby a first leg of the L-shaped lever 30 is formed by a pressure area 31 while a second leg is formed by a connecting area 32. In the connecting area 32, the lever 30 is attached to the connecting member 20. The pressure area 31 extends along the outside 13 of the first segment 11, which faces away from the inside of the ring 3. In order to allow a maximum lever path, there are no further elements between the outside 13 of the first segment 11 and the pressure area 31, that is to say, the space 14 between the first segment 11 and the pressure area 31 of the lever 30 is left free.

As is especially shown in FIG. 2, the pressure area 31 of the lever, together with the handle, encloses an angle of about 3°, that is to say, the longitudinal axis 73 of the lever 30 in the pressure area 31 runs at an angle of about 3° relative to the longitudinal axis 76 of the handle 6.

As merely sketched in FIG. 4, the lever 30 can also be angled multiple times, e.g. twice, so that it can be even better adapted to the shape of the first segment 11 that is beneath it. Due to the second bend which, like the first bend, is oriented towards the first segment 11, the side of the lever 30 facing away from the connecting area 32 has a rear area 33 that is angled with respect to the pressure area 31 located between the connecting area 32 and the rear area 33.

For purposes of opening the ring 3, the lever 30 is pressed in its pressure area 31 towards the inside of the ring 3, in other words, also towards the adjacent first segment 11. This can be done, for example, by the thumb of a user while gripping the handle 6 of the wrench with the fingers. Therefore, according to the invention, a wrench configured as a box wrench is provided which has a ratcheting function as well as an opening function.

Figure 6:
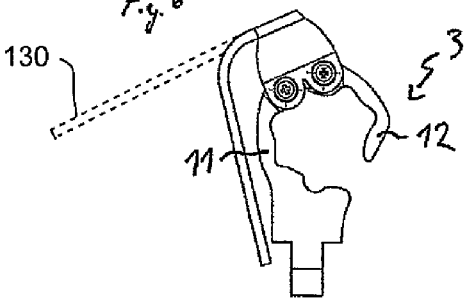
FIG. 6: the wrench from FIG. 1, with the ring swiveled open, in a front view.

FIG. 6 also shows schematically an alternate lever 130 which is not bent.

What is claimed is:

1. A wrench comprising:

a handle;

a ring swivelable to open to permit gripping of a screw head or a nut with a positive fit, the ring having a first segment arranged on the handle, a free second segment, and a connecting member joining the second segment to the first segment in an articulated manner; and a lever provided on the connecting member capable of swiveling open the ring, the ring being ratchetable.

2. The wrench as recited in claim 1 wherein the lever is pressable towards the first segment to cause the ring to open.

3. The wrench as recited in claim 1 wherein the lever extends, at least in certain sections, along an outside of the first segment facing away from at least one of the second segment and from an inside of the ring.

4. The wrench as recited in claim 1 wherein the lever has a pressure area, the pressure area and the handle defining an angle smaller than 45°.

5. The wrench as recited in claim 4 wherein a space between the pressure area of the lever and the first segment is left free.

6. The wrench as recited in claim 1 wherein the connecting member is articulated onto the first segment to be pivotable around a first pivot axis, and the second segment is articulated onto the connecting member to be pivotable around a second pivot axis, the first pivot axis and the second pivot axis being at least one of parallel to each other and at a distance from each other.

7. The wrench as recited in claim 6 wherein the lever runs parallel to the first and second pivot axes along its entire length.

8. The wrench as recited in claim 1 wherein the lever is L-shaped, at least in certain areas.

9. The wrench as recited in claim 1 wherein the lever is made of a bent metal sheet.

10. The wrench as recited in claim 1 wherein the connecting member has a front bearing plate, a rear bearing plate and a middle web joining the front and rear bearing plates, the lever being attached to the middle web, and the connecting member having a pivot pin for the first segment, and a second pivot pin for the second segment, the first and second pivot pins extending between the front and rear bearing plates.

11. The wrench as recited in claim 1 wherein a compression spring is arranged between the first and second segments to force the ring into a closed position.

12. The wrench as recited in claim 1 wherein the first segment has a first tooth and the second segment has a second tooth, a flank of the first tooth facing an inside of the ring being in contact with the second tooth.

13. The wrench as recited in claim 1 wherein the wrench, as seen through the ring, has a front for facing an observer and a rear facing away from the observer, the front having a colored or geometrical marking to distinguish the front from the rear.

14. The wrench as recited in claim 1 wherein the first segment has at least one edge located inside the ring, and the second segment has at least one further edge located inside the ring.

15. A wrench comprising:

a handle;

a ring swivelable to open to permit gripping of a screw head or a nut with a positive fit, the ring having a first segment arranged on the handle, a free second segment, and a connecting member joining the second segment to the first segment in an articulated manner; and a lever provided on the connecting member capable of swiveling open the ring, the lever being L-shaped, at least in certain areas.

16. A wrench comprising:

a handle;

a ring swivelable to open to permit gripping of a screw head or a nut with a positive fit, the ring having a first segment arranged on the handle, a free second segment, and a connecting member joining the second segment to the first segment in an articulated manner; and a lever provided on the connecting member capable of swiveling open the ring, the connecting member having a front bearing plate, a rear bearing plate and a middle web joining the front and rear bearing plates, the lever being attached to the middle web, and the connecting member having a pivot pin for the first segment, and a second pivot pin for the second segment, the first and second pivot pins extending between the front and rear bearing plates.

17. A wrench comprising:

a handle;

a ring swivelable to open to permit gripping of a screw head or a nut with a positive fit, the ring having a first segment arranged on the handle, a free second segment, and a connecting member joining the second segment to the first segment in an articulated manner; and a lever provided on the connecting member capable of swiveling open the ring, the first segment having a first tooth and the second segment has a second tooth, a flank of the first tooth facing an inside of the ring being in contact with the second tooth.

* * * * *